US006959891B2

(12) United States Patent
Kapiloff et al.

(10) Patent No.: US 6,959,891 B2
(45) Date of Patent: Nov. 1, 2005

(54) DISPENSER FOR MULTIPLE ROLLS OF SHEET MATERIAL

(75) Inventors: David W. Kapiloff, Gainesville, GA (US); Stephen L. Phelps, Lilburn, GA (US); William G. Haen, DePere, WI (US); Troy E. Westcott, Bonduel, WI (US); Paul A. Haase, New London, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/190,128

(22) Filed: Jul. 3, 2002

(65) Prior Publication Data

US 2004/0004153 A1 Jan. 8, 2004

(51) Int. Cl.[7] ..... B65H 49/26; B65H 49/38; B65H 18/04

(52) U.S. Cl. ..... 242/597.8; 242/597.5; 242/594.5; 242/591

(58) Field of Search ..... 242/597, 597.5, 242/597.8, 594, 594.5, 591; 6/512

(56) References Cited

U.S. PATENT DOCUMENTS

| | | | | | |
|---|---|---|---|---|---|
| 3,090,572 | A | * | 5/1963 | Metcalf | 242/423.1 |
| 3,294,329 | A | * | 12/1966 | Tucker et al. | 242/560.3 |
| 3,948,454 | A | * | 4/1976 | Bastian | 242/560.3 |
| 4,003,526 | A | | 1/1977 | Fishburn | |
| 4,108,513 | A | * | 8/1978 | Lander | 225/34 |
| 4,375,874 | A | | 3/1983 | Leotta et al. | |
| 4,422,584 | A | | 12/1983 | Dashnier et al. | |
| 4,422,585 | A | | 12/1983 | Schultz et al. | |
| 4,463,912 | A | * | 8/1984 | Grunerud | 242/560.2 |
| 4,557,426 | A | | 12/1985 | Siciliano | |
| 4,606,510 | A | * | 8/1986 | McEntire | 242/560.3 |
| 4,796,832 | A | * | 1/1989 | Schutz et al. | 242/594.5 |
| 4,989,800 | A | | 2/1991 | Tritch | |
| 5,294,192 | A | | 3/1994 | Omdoll et al. | |
| 5,310,129 | A | | 5/1994 | Whittington et al. | |
| 5,314,131 | A | | 5/1994 | McCanless et al. | |
| 5,449,127 | A | * | 9/1995 | Davis | 242/560 |
| 5,456,420 | A | | 10/1995 | Frazier | |
| 5,601,253 | A | | 2/1997 | Formon et al. | |
| 5,618,008 | A | * | 4/1997 | Dearwester et al. | 242/594.5 |
| 5,636,812 | A | | 6/1997 | Conner et al. | |
| 5,645,244 | A | | 7/1997 | Moody | |
| 5,669,576 | A | | 9/1997 | Moody | |
| 5,833,169 | A | | 11/1998 | Morand | |
| 6,036,134 | A | * | 3/2000 | Moody | 242/422.4 |
| 6,098,919 | A | | 8/2000 | Lewis | |
| 6,267,321 | B1 | | 7/2001 | Tramontina | |
| 6,302,604 | B1 | * | 10/2001 | Bryant et al. | 400/619 |
| 6,364,245 | B1 | | 4/2002 | Paal et al. | |
| 6,409,120 | B1 | * | 6/2002 | Tramontina et al. | 242/594.5 |

* cited by examiner

*Primary Examiner*—Kathy Matecki
*Assistant Examiner*—Evan Langdon
(74) *Attorney, Agent, or Firm*—Sue C. Watson

(57) ABSTRACT

A dispenser for storing and dispensing rolled sheet material is provided. The dispenser has a housing which holds at least one roll of sheet material therein. The housing has a portion of an outer surface which is positioned against a support surface. The housing also has an opening defined by a perimeter configured to provide two hub positions. The dispenser also has a hub configured to receive at least one roll of sheet material. The hub has a first end and a second end. The first end is positioned to extend through at least a portion of one hub position. The hub has a flange which is positioned radially around at least a portion of the hub near the second end. The flange has a perimeter which is larger than the perimeter of the hub positions, and is supported against the outer surface of the housing. The hub is configured to be positioned to hold one of a jumbo roll, a mid-sized roll, and a stub roll.

20 Claims, 6 Drawing Sheets

DISPENSER FOR MULTIPLE ROLLS OF SHEET MATERIAL

FIELD OF THE INVENTION

This invention generally relates to dispensers, and more specifically, to dispensers for rolled sheet material. More particularly, this invention relates to a dispenser for multiple rolls of sheet material.

BACKGROUND

Dispensers for bath tissue used in institutional and public restrooms are often configured to provide a "jumbo" roll of sheet material or bath tissue therein. In addition, some of these dispensers are configured to accommodate a second much smaller roll, or stub roll, which is disposed alongside the jumbo roll. In other dispensers, two or more rolls of equal diameter are disposed therein. Either type of dispenser commonly includes one or more mandrels or hubs which hold the roll(s). Dispensers have therefore been required to be configured to utilize either the jumbo sized roll and the stub roll combination, or the combination of two rolls of equal diameter. Dispensers have not had the flexibility in configuration to permit a choice of diameters of rolls to be positioned therein.

Since various manufacturers offer rolls of sheet material having different diameters, and since prices for such rolls vary, it would be advantageous to have a dispenser that could accommodate several different diameters of rolls, and several different combinations. Such a dispenser provides movable mandrels or hubs which permit the use of various diameters of rolls of sheet material or bath tissue in the dispenser.

Definitions

As used herein, the term "exit port" or "dispensing opening" is the opening in a housing of a dispenser for the passage of sheet material out of the dispenser.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, spring-loaded hinges, living hinges, and so forth. Living hinges may be constructed from plastic and other materials and formed integrally between two members. A living hinge permits pivotable movement of one member in relation to another connected member.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, bath/toilet tissue, paper towels, wipes, label rolls, or other fibrous, film, polymers, or filamentary products.

As used herein, the term "couple" includes, but is not limited to, joining, connecting, fastening, linking, or associating two things integrally or interstitially together.

As used herein, the term "arcuate" includes, but is not limited to, having the form generally of a curve or an arch.

SUMMARY OF THE INVENTION

In one aspect of the invention, a dispenser for storing and dispensing rolled sheet material is provided. The dispenser has a housing configured to hold at least one roll of sheet material therein, the housing is formed to include an exit port. The housing includes a portion of an outer surface which is positioned against a support surface. The housing also has an opening defined by a perimeter which is configured to provide two hub positions. A hub is provided, which is configured to receive at least one roll of sheet material. The hub has a first end and a second end. The first end is positioned to extend through at least a portion of one hub position. A flange is positioned radially around at least a portion of the hub near the second end. The flange has a perimeter which is larger than the perimeter of the hub positions. The flange is supported against the outer surface of the housing. The hub is configured to be removed and reinserted in another one of the two hub positions so that the hub is positioned to hold one of a jumbo roll, a mid-sized roll, and a stub roll.

DETAILED DESCRIPTION

Figure 1:
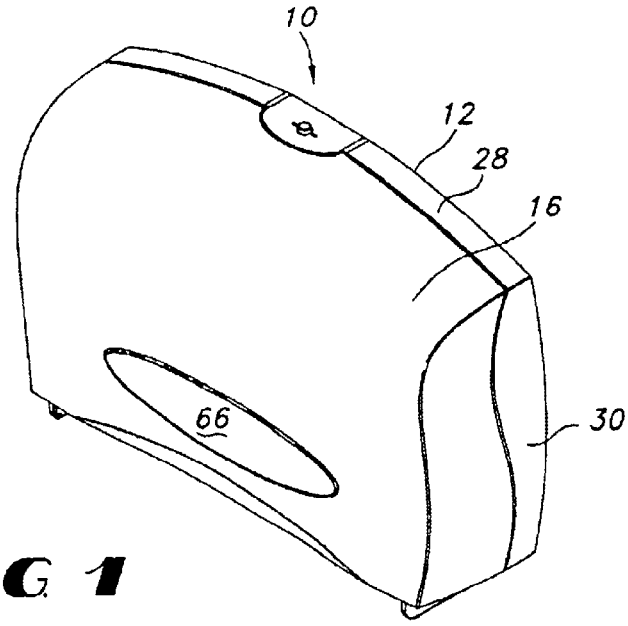
FIG. 1 is a perspective view of the dispenser of the present invention, in a closed dispensing position.

Reference will now be made in detail to the presently preferred embodiments of the invention, one or more examples of which are illustrated in the drawings. Each example is provided by way of explanation of the invention and is not meant as a limitation of the invention. For example, features illustrated are described as part of one embodiment or figure can be used on another embodiment or figure to yield yet another embodiment. It is intended that the present invention include such modifications and variations.

Figure 2:
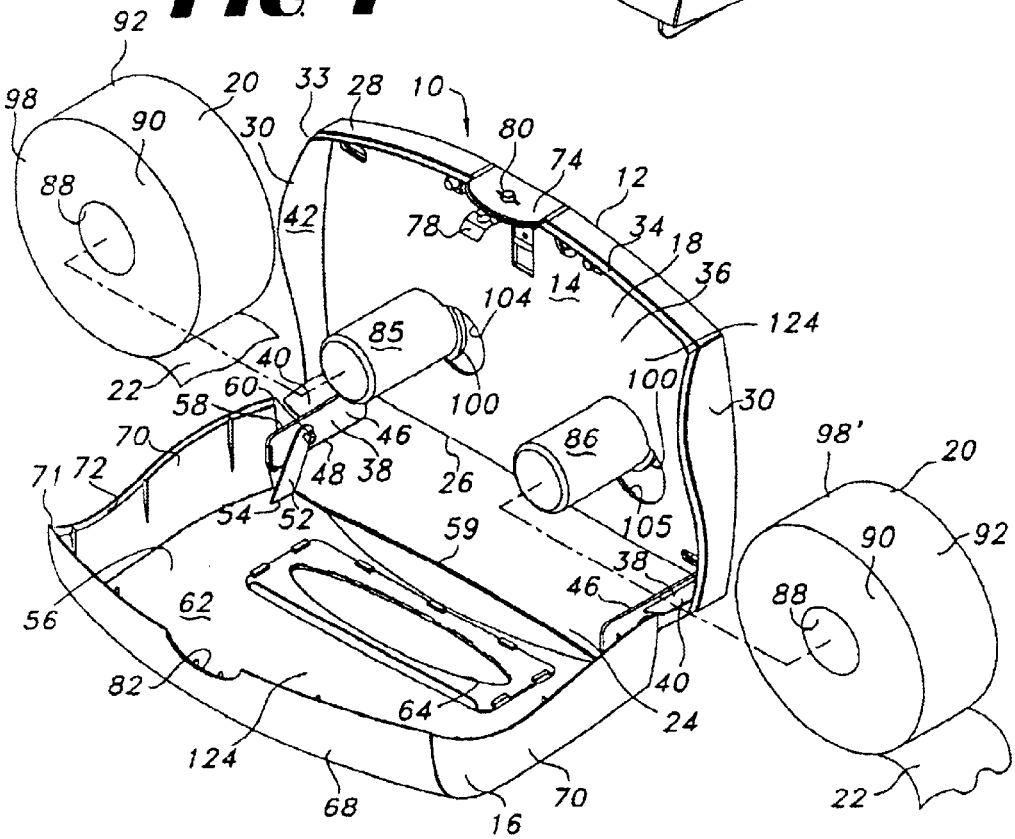
FIG. 2 is a perspective view of the dispenser of the present invention, in an opened, loading position, illustrating a back plate, a cover, two movable hubs, and two mid-sized rolls.

As illustrated in FIGS. 1–6, the dispenser 10 includes a housing 12, which has a back plate 14 and a cover 16, as shown best in FIGS. 1 and 2. The back plate 14 and the cover 16 cooperate when positioned together in a closed position to provide an internal compartment 18 configured to hold one or more rolls 20 of sheet material 22. The back plate 14 and cover 16 also cooperate to form, in a closed position, a dispensing opening or exit port 24 which provides a user access to the sheet material 22, as shown generally in FIGS. 3–5. In the present embodiment, but not by way of limitation, the exit port 24 is provided in a lower end 26 of the housing 12.

The back plate 14 has a top wall 28 which is positioned generally perpendicularly about a portion of its perimeter, as illustrated in FIG. 2. The top wall 28 is contiguous with a pair of spaced-apart opposing side walls 30 which also adjoin the back plate 14. The back plate 14 is configured to be mounted on a surface or wall, such as, by way of non-limiting example, the wall of a toilet stall (not shown). The back plate 14 includes a plurality of openings 32 to permit such mounting via fasteners, brackets, hinges, adhesives, and so forth. Each side wall 30 and the top wall 28 at a common edge 33 thereof includes an inner lip portion 34 which is slightly recessed relative to an outer surface 36 of the back plate 14.

The back plate 14 also includes a pair of spaced-apart and confronting flange and bar assemblies 38 (FIG. 2). Each flange 40 is coupled to or integrally formed with an inner surface 42 near a lower end 44 of each of the side walls 30 of the back plate 14, and has a bar 46 integrally formed therewith or coupled thereto, as shown in FIGS. 2–5. Each bar 46 of the flange and bar assemblies 38 includes a serrated portion 48 along a lower edge and front edge of the bar 46, to permit sections of sheet material 22 to be removed from one or more rolls 20 of sheet material 22 disposed in the internal compartment 18 of the housing 12.

The cover 16, as shown in FIG. 2, is pivotably coupled to the housing 12 via a spaced-apart pair of cover bars 52 which, at a first end 54, are fixedly coupled to or formed integrally with an inner surface 56 of the cover 16. At a second end 58, the cover bars 52 are pivotably coupled via a pivot pin 60, and so forth, to each bar 46 of each of the bar and flange assemblies 38. It will be understood that hinges, fasteners, and so forth may be used to releasably couple the cover 16 to the back plate 14. A lower end 59 of the cover may include a serrated portion as well (not shown).

The cover 16 includes a front plate 62 having a window opening 64 provided therein. A window plate 66 (FIG. 1) is mounted on an inner surface 56 of the front plate 62 over the window opening 64. The window plate 66 is usually, for example, but not by way of limitation, clear, transparent, tinted, and so forth, to provide a view of the size and amount of the remaining roll(s) 20 of sheet material 22 in the dispenser 10 to a user or a maintenance technician. It will be appreciated, however, that any portion(s) of the housing 12 may be clear, transparent, tinted, opaque, and so forth. The front plate 62 includes a contiguous top wall 68 and a pair of spaced-apart opposing side walls 70 which are each formed with and positioned generally perpendicularly to a portion of the perimeter of the front plate 62. The side walls 70 and top wall 68 each include, near a common edge 71, an outer lip portion 72 which is slightly recessed relative to an inner surface 56 of the cover 16.

The top wall 28 of the back plate 14 also includes a convex portion 74 having a latch mechanism coupled thereto, as illustrated in FIG. 2. The latch mechanism includes a latch 78 and a button 80 which are coupled to the inner surface 42 of the back plate 16. The button 80 extends through an opening in the convex portion 74. The top wall 68 of the cover 16 also includes a concave portion 82 configured to receive the convex portion 74 of the top wall 28 of the back plate 16 therein. In addition, the inner surface 56 of the cover 16 includes a reciprocal latch coupler (not shown), which permits the latch 78 to be releasably coupled to the cover 16, thereby permitting the cover 16 to be positioned and maintained in a closed dispensing position relative to the back plate 14. The button 80 may be positioned in a coplanar position relative to the outer surface 36 of the top wall 28, and may include a key hole to permit the latch mechanism to be locked (not shown). Any latch and/or lock mechanism may be used to close/lock the housing 12 to prevent tampering and/or vandalism; many are known in the art.

When the cover 16 is closed against the back plate 14 in the closed dispensing position, the outer lip portion 72 of the cover 16 is cooperatively positioned adjacent the inner lip portion 34 of the back plate 14. Neither the back plate 14 nor the cover 16 includes a bottom wall; therefore, when the housing 12 is in the closed dispensing position, the exit port 24 is provided by the lower end 26 of the housing 12. It will be appreciated that in the present embodiment, the configuration of the housing 12 is not intended as a limitation; other configurations may be used to accommodate aesthetic and/or functional considerations.

As shown in FIGS. 2–7, mounted on the back plate 16 and extending generally perpendicularly therefrom are a pair of mandrels/hubs 85, 86. The hubs 85, 86 each hold a roll 20 of sheet material 22. Such sheet material is often flexible, such as toilet or bath tissue and so forth. Each roll 20 is wound throughout its diameter about a longitudinal open core 88 to form, generally, a cylinder having opposing flat ends 90. The sheet material 22 forming the roll 20 is desirably perforated into sheet sections of predetermined length, although non-perforated sheet material may also be used.

The dispenser 10 and housing 12 are desirably configured to hold at least two rolls 20 of sheet material 22. The rolls 20 are positioned on the hubs 85, 86 such that the core 88 of each roll 20 is mounted on a hub 85, 86 and each roll 20 is mounted with its outer perimeter 92 adjacent the other. One flat end 90 of each roll 20 is positioned adjacent the back plate 14 while the opposite flat end 90 of each roll 20 is positioned adjacent the front plate 62 of the cover 16.

The dispenser 10 of the present embodiment is designed to hold a combination of large, medium, and small rolls, in non-limiting combinations. That is, in a non-limiting example, the dispenser desirably holds within its internal compartment 18 a combination of either: a) a jumbo roll 94, generally, but not by way of limitation, having a diameter greater than about 9.5 inches, and a stub roll 96, generally, but not by way of limitation, having a diameter of less than about 7 inches; or b) two medium-sized rolls 98, 98' (hereinafter termed "mid-sized" roll(s)) generally, but not by way of limitation, having a diameter of greater than about 7 inches to about 9.5 inches. It will be appreciated that the dispenser 10 and the housing 12 may be sized to include additional hubs to hold additional rolls of one or more roll sizes in additional combinations.

Figure 3:
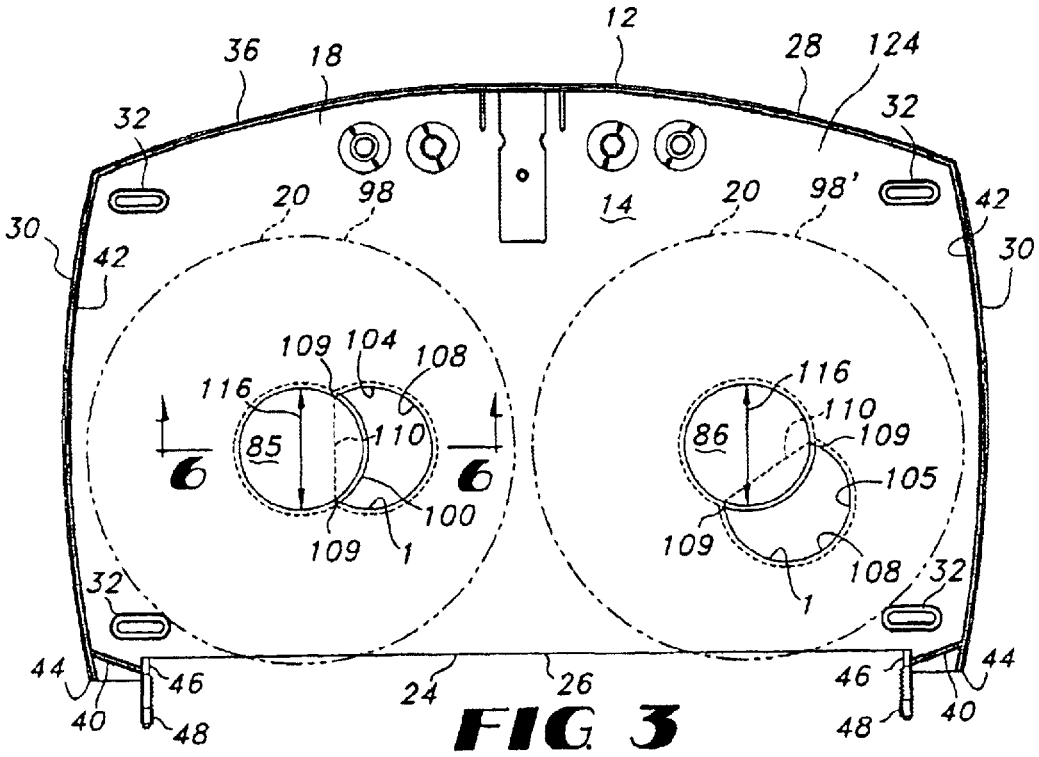
FIG. 3 is a front view of a back plate of the dispenser of FIG. 2, showing the position of the hubs for two rolls of equal diameter (the rolls illustrated in phantom lines)
Figure 4:
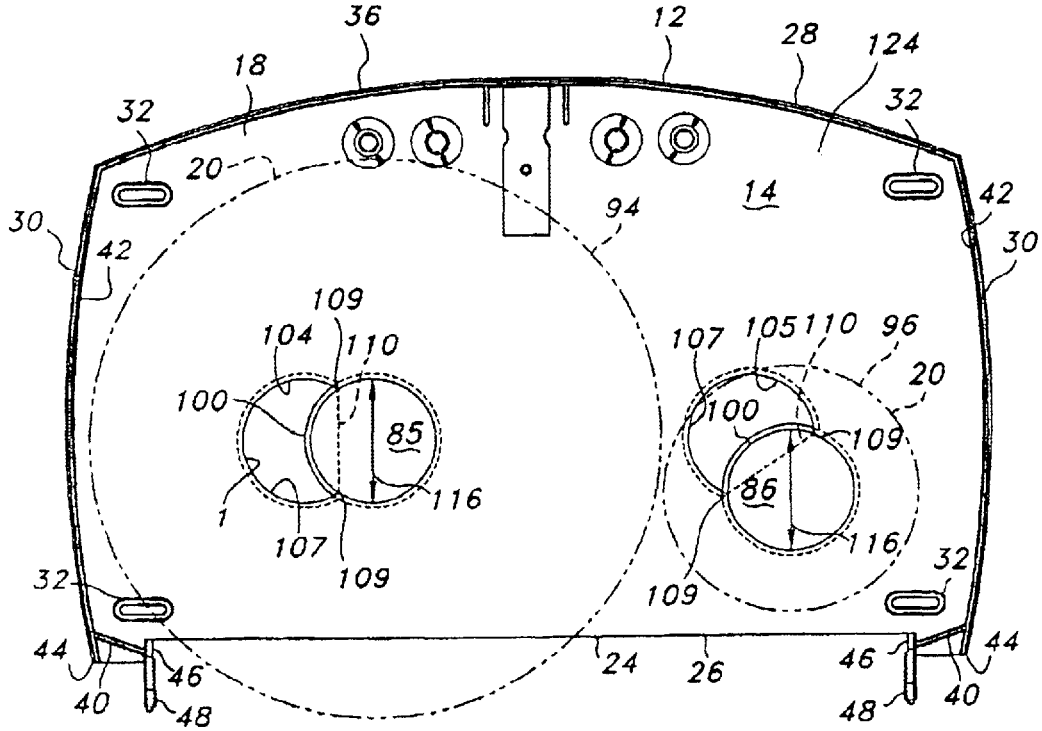
FIG. 4 is a front view of the back plate of the dispenser of FIG. 2, but showing the position of the hubs for a jumbo roll and stub roll combination (the rolls illustrated in phantom lines)
Figure 5:
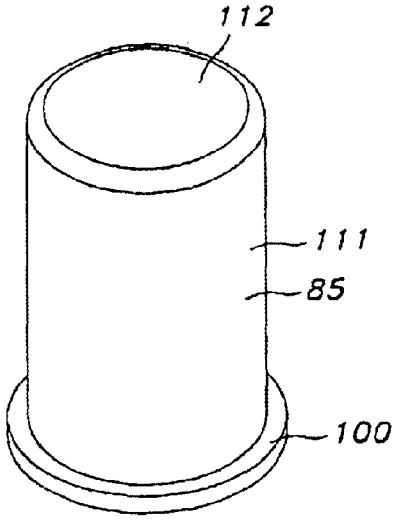
FIG. 5 is a perspective view of one of the hubs shown in FIGS. 2–4.

Referring to FIGS. 2–6, each hub 85, 86 includes a circular flange 100 which extends radially outward a short distance away from each hub 85, 86. Hubs 85, 86, are positioned through openings 104, 105, respectively, in the back plate 14. Each opening 104, 105 is positioned spaced-apart from the other. In addition, in the present embodiment, the openings 104, 105 each generally, but not by way of limitation, provide a configuration of two overlapping round circles or round portions 107, 108. Each opening 104, 105 is defined by a perimeter 106, which is sized to receive one of the hubs 85, 86, in one of the two overlapping round portions 107, 108. That is, each hub 85, 86 is removably positioned in either round portion 107 or round portion 108 of the openings 104, 105, respectively. The perimeter 106 includes a pair of convex portions 109, as shown in FIGS. 3–4, which define a point of overlap between round portions 107, 108. The distance 110 between the convex portions 109 is less than a diameter 116 of each hub 85, 86.

Figure 6:
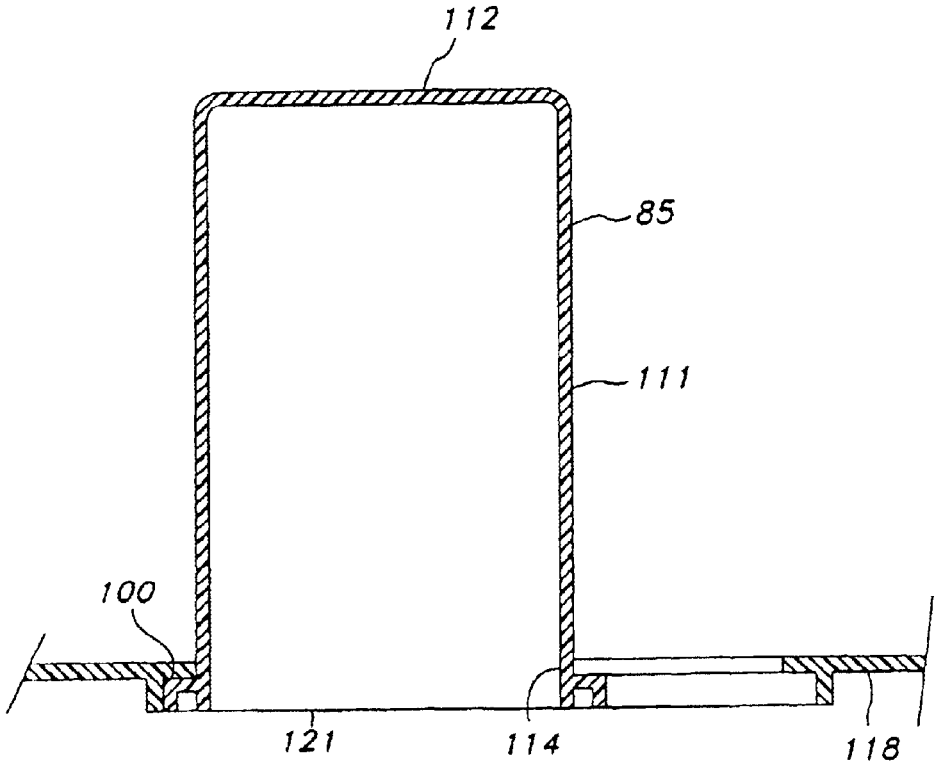
FIG. 6 is a sectional view of FIG. 3 taken along line 6—6.
Figure 7:
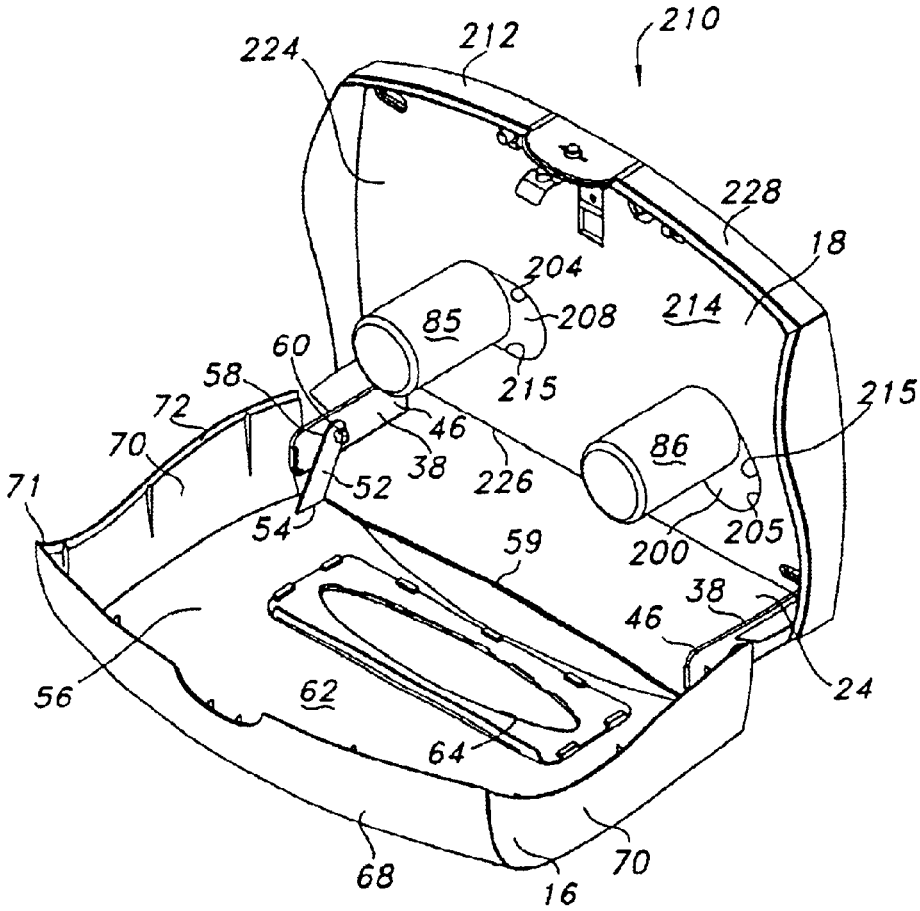
FIG. 7 is a perspective view of another embodiment of the dispenser of the present invention, in an opened, loading position, illustrating a back plate, a cover, and two movable hubs.

Each hub 85, 86 includes a generally cylindrically-shaped base 111 having a first or closed end 112, and an opposite second or open end 114, as shown in FIGS. 6 and 7. The circular flange 100 is positioned near the open end 114.

Returning to the back plate 14, as illustrated in FIGS. 2–4 and 6, the perimeter 106 of each opening 104, 105 closely surrounds the base 111 of each hub 85, 86 when it is positioned in one of the round portions 107, 108 or the openings 85, 86. Each hub 85, 86 is positioned in the housing 12 by inserting the closed end 112 from a back side 118 (FIG. 6) of the back plate 14 through one of the round portions 107, 108 of one of the openings 104, 105. The circular flange 100 contacts the back side 118 (FIG. 6) of the back plate 14, and the circular flange 100 is positioned between the back plate 14 and a support surface 121 which assists in supporting and non-movably retaining each hub 85, 86 in each opening 104, 105 and in a position to receive a roll 20. That is, each hub 85, 86 is supported in a generally perpendicular position relative to the back plate 14 and extends transversely across the internal compartment 18 of the housing 12 by cooperation of certain components. Namely, the combination of the configuration of the perimeter 106 around each round portion 107, 108 of each opening 104, 105, the position and location of the convex portions 109, the diameter and positioning of the circular flange 100 that encircles and extends radially about the base 111 near the open end 114 of each hub 85, 86, and the positioning of the circular flange 100 against the back side 118 of the back plate 14 by the support surface 121 (FIG. 6). It will be understood that each hub 85, 86, is supported only by the back plate 14 of the housing 12, and the closed end 112 is not substantially supported by any structure(s) in the housing 12.

Each hub 85, 86 may be positioned in at least two positions which are selected by a maintenance technician. The two positions permit a maintenance technician to adjust the dispenser to hold two rolls having substantially the same diameter, such as two mid-sized rolls 98, 98', as illustrated in FIGS. 2 and 3, or two rolls having substantially different diameters, such as a jumbo roll 94 and a stub roll 96, as shown in FIG. 4.

As illustrated in FIGS. 2 and 3, when hubs 85, 86 are each positioned in round portion 107 of opening 104 and 105, respectively, the hubs 85, 86 are each positioned generally in a horizontal alignment relative to the lower end 26 of the housing 12, and relative to each other. In this position, the hubs 85, 86 are positioned relative to the inner surface 124 of the housing 12, the internal compartment 18, and each other to each hold a mid-sized roll 98, 98'.

As shown in FIG. 4, when hub 85 is positioned in round portion 108 of opening 104, and hub 86 is positioned in round portion 108 of opening 105, the hubs 85, 86 are each positioned generally out of horizontal alignment relative to the lower end 26 of the housing 12 and relative to each other. In this position, the hubs 85, 86 are positioned relative to the inner surface 124 of the housing 12, the internal compartment and each other to hold a jumbo roll 94 and a stub roll 96, respectively.

Such movement and positioning of the hubs 85, 86 permit a maintenance technician to pre-set the dispenser for the size of rolls in stock, whether a mid-sized roll, a jumbo roll, or a left-over stub roll. It will be appreciated that other roll size combinations may be used; the foregoing examples are meant to merely illustrate two combinations which are desirable.

In a method of use, the cover 16 is moved away from the back plate 14, as illustrated in FIGS. 2–4 and 6, thereby positioning the housing in an opened loading position for receiving one or more rolls 20 of sheet material 22. The dispenser 10 is either removed from the support surface 121 (not shown) or, alternatively, the housing 12 is lifted up via a hinge (not shown) coupling the dispenser 10 to the support surface 121 (not shown). The maintenance technician then removes and/or re-inserts each hub 85, 86 in the desired round portion 107, 108 of each opening 104, 105, so that the dispenser 10 is set to hold and dispense either two mid-sized rolls 98, 98', or a jumbo roll 94 and stub roll 96. It will be understood that the hubs 85, 86 are set so that the outer perimeter 92 of the rolls 20 are positioned to avoid substantial contact with an inner surface 124 of the housing 12, or each other.

Once the hubs 85, 86 have been positioned, the dispenser 10 is re-coupled to the support surface 121 or the housing 12 is re-positioned on the support surface 121. The selected rolls 20 are mounted on the hubs 85, 86, and the housing 12 is closed as previously described herein. The sheet material 22 on each roll 20 is then in a position to be dispensed to a user through the exit port 24.

Figure 8:
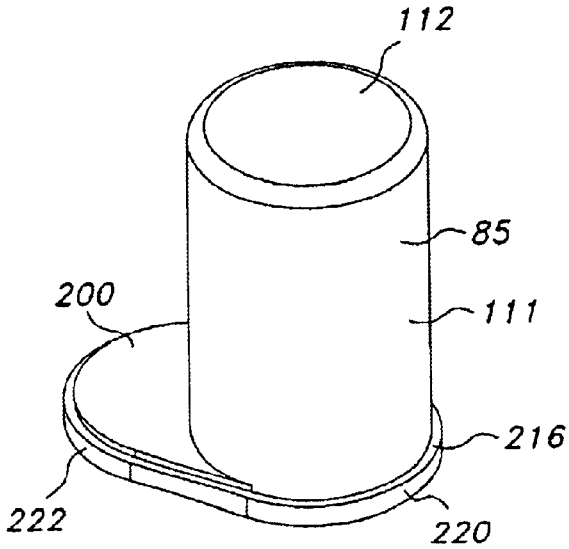
FIG. 8 is a perspective view of one of the hubs shown in FIG. 7.
Figure 9:
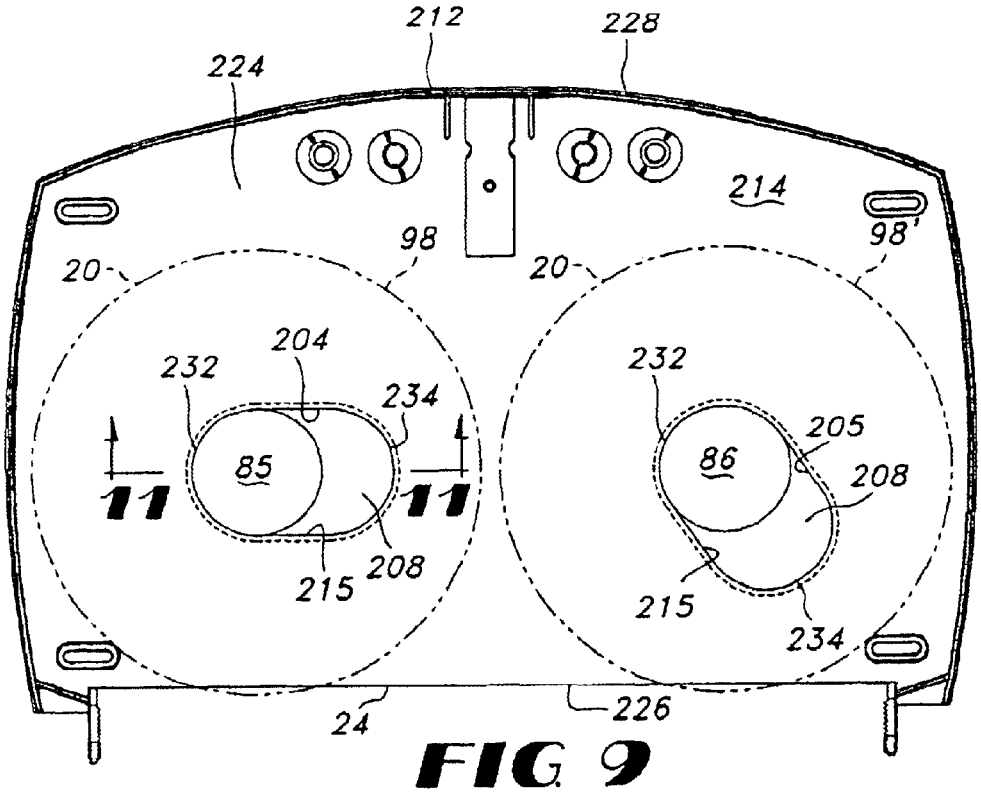
FIG. 9 is a front view of a back plate of the dispenser of FIG. 7, but showing the hubs positioned for holding two rolls of equal diameter (the rolls illustrated in phantom lines)
Figure 10:
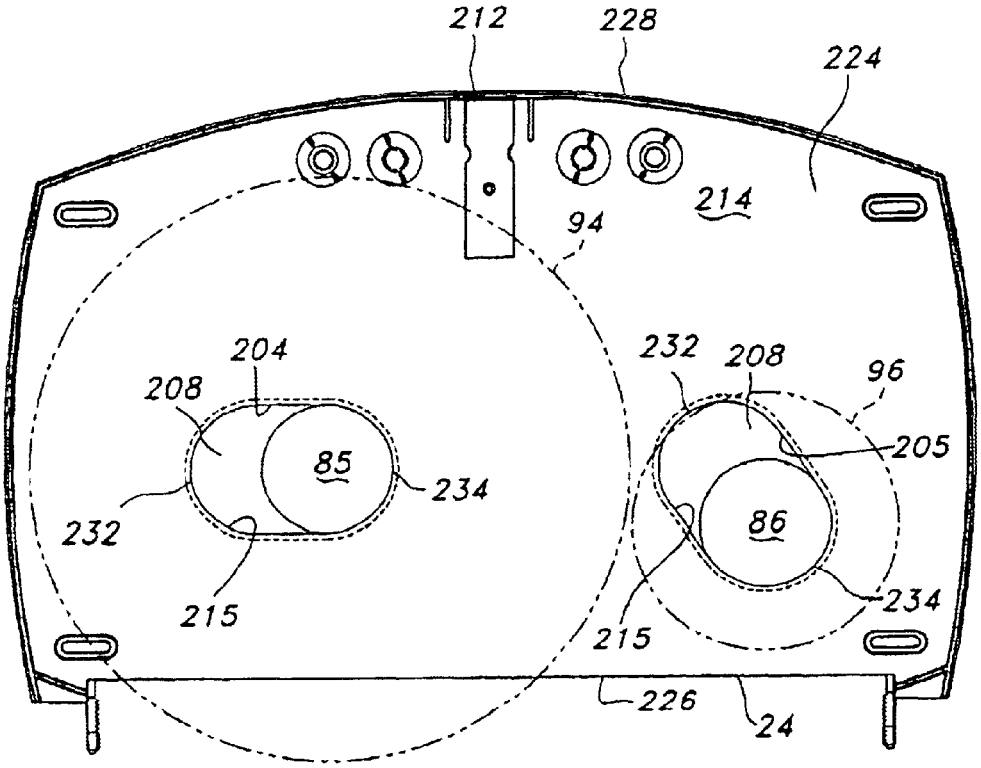
FIG. 10 is a front view of the back plate similar of the dispenser of FIG. 9, but showing the position of the hubs for holding a combination of a jumbo roll and a stub roll (the rolls illustrated in phantom lines)
Figure 11:
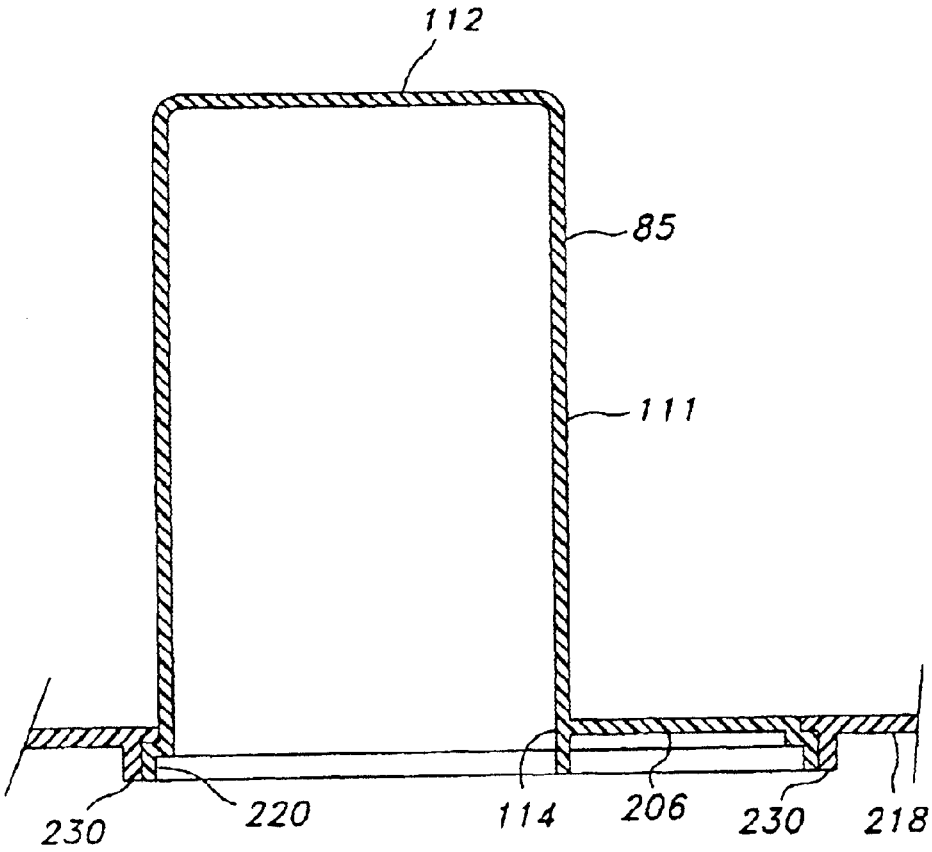
FIG. 11 is a sectional view of FIG. 9 taken along line 11—11.

In another embodiment of the invention, as illustrated in FIGS. 7–11, the dispenser 210 is very similar to the dispenser 10. The openings 204, 205, and the perimeter 215 defining the openings 204, 205, however, are generally, but not by way of limitation, oval in configuration, as shown in FIGS. 7, 9 and 10. Each hub 85, 86 has positioned near one end 216 thereof of an oval flange 200 which includes a flange portion 220 which is positioned close to a portion of each hub 85, 86 near the end 114 thereof, as illustrated in FIGS. 8 and 11. The flange 200 has a similar, but not by way of limitation, oval configuration which includes a perimeter 222 having a slightly larger dimension as compared to the perimeter 215 of the openings 204, 205. Opening 204, similar to opening 104, is positioned generally horizontally relative to the lower end 226 of the housing 212. Opening 205, similar to opening 105, is positioned at an oblique angle relative to the lower end 226 of the housing 212.

A retaining rib 230 is positioned near the perimeter 215 of each opening 204, 205 on the back side 218 of the back plate 214. The retaining rib 230 is configured to have similar but slightly larger dimension than the flange 200, and is configured to retain each flange 200 of each hub 85, 86 in position, when the hubs 85, 86 are inserted from the back side 218 into the openings 204, 205, respectively, and each flange 200 is positioned and confined within each retaining rib 230.

Each retaining rib 230 is configured to retain each flange 200 in a fixed position to prevent movement of hubs 85, 86. To this end, each hub 85, 86 is supported in a generally perpendicular position relative to the back plate 214 and extends transversely across the internal compartment 18 of the housing 212 by cooperation of the retaining rib 230 which supports the flange 200 of each hub 85, 86 securely therein, and the support surface 121 which assists in retaining the flange 200 of each hub 85, 86 in the retaining rib 230 and against the back side 218 of the back plate 214, thereby positioning and maintaining each hub 85, 86, in a non-moving position to receive and hold a roll 20 for dispensing.

Each hub 85, 86 may be positioned in at least two positions which are selected by a maintenance technician. The two positions permit a maintenance technician to adjust the dispenser 212 to hold two rolls 20 having substantially the same diameter, such as two mid-sized rolls 98, 98', as illustrated in FIG. 9, or two rolls having substantially different diameters, such as a jumbo roll 94 and a stub roll 96, as shown in FIG. 10.

As illustrated in FIG. 9, when hubs 85, 86 are each positioned so that hubs are adjacent an end portion 232 of the perimeter 215 of each opening 204, 205, respectively, the hubs 85, 86 are each positioned generally in a horizontal alignment relative to the lower end 226 of housing 212, and relative to each other. In this position, the hubs 85, 86 are positioned relative to the inner surface 224 of the housing 12, the internal compartment 18, and each other to each hold a mid-sized roll 98, 98'.

As shown in FIG. 10, when hubs 85, 86 are positioned in an end portion 234 of openings 204, 205, the hubs 85, 86 are each positioned generally out of horizontal alignment relative to the lower end 226 of the housing 212 and relative to each other. In this position, the hubs 85, 86 are positioned relative to the inner surface 224 of the housing 212, the internal compartment and each other to hold a jumbo roll 94 and a stub roll 96, respectively. Such movement and positioning of the hubs 85, 86 again permits a maintenance technician to pre-set the dispenser for the size of rolls in stock, whether a mid-sized roll, a jumbo roll, or a left-over stub roll.

In a method of use, as illustrated generally in FIGS. 7, 9, and 11, the cover 16 is moved away from the back plate 214 (FIG. 7), thereby positioning the housing 212 in an opened loading position for receiving one or more rolls of sheet material (shown in phantom lines in FIGS. 9 and 10). The dispenser 210 is either removed from the support surface 121 (not shown) or the housing 212 is lifted up via a hinge (not shown) coupling the dispenser 210 to the support surface 121 (not shown). The maintenance technician then removes and/or re-inserts each hub 85, 86 with each hub positioned in the desired end portion 232, 234 of each opening 204, 205, so that the dispenser 210 is set to retain and dispense a combination of either two mid-sized rolls 98, 98', or a jumbo roll 94 and stub roll 96, as described above.

Once the hubs 85, 86 have been positioned, the dispenser 210 is re-coupled to the support surface 121 (FIG. 11), or the housing 212 is re-positioned on the support surface 121. The selected rolls 20 are mounted on the hubs 85, 86, and the housing 212 is closed as previously described herein. The sheet material 22 on each roll 20 is then in a position to be dispensed to a user through the exit port 24.

It will be appreciated that, in all embodiments, the present removable hubs are positioned within the internal compartment of the housing to allow different sizes of rolls to be contained therein, in various combinations. The hubs do not move to position a roll closer to the exit port; rolls of all sizes shown and described herein are already positioned adjacent the exit port for a user to access one or both rolls, as desired. Rather, each hub is moved to its preselected position as described above, to desirably permit the housing hold either rolls of substantially different diameters, or rolls of substantially similar diameters. That is, each of the hubs, in the present embodiments, and by way of nonlimiting examples, are positionable to hold a combination of either a jumbo roll and a stub roll, or two mid-sized rolls within the internal compartment of the housing, without the outer perimeter of one or more rolls substantially contacting the outer perimeter of another roll, or the inner surface of the housing.

It will further be recognized that, in each embodiment illustrated herein, each hub is also positioned generally transversely across the internal compartment of the housing, and each hub is supported in a generally perpendicular position relative to the back plate, such that each hub is supported at one end by its respective flange and has an opposite free end which is not coupled to the housing. Further, the free end of each hub may include a flange as well (not shown), and so forth, to support the roll in proper alignment for dispensing with respect to the inner surface of the housing, so that the weight of the roll will not cause displacement of the hub and roll relative to the inner surface of the housing. Such use of a flange, and so forth, may assist in supporting the roll to prevent the roll from touching or rubbing against the inner surface of the housing.

Finally, as applied to all embodiments shown and/or described herein, it will be appreciated that the flange supporting each hub may be removably supported against the back side of the housing by clips, snaps, and so forth.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser for storing and dispensing rolled sheet material, comprising:

a housing having a lower end and an internal compartment configured to hold at least two rolls of sheet material therein and formed to include an exit port, the housing having an outer surface positioned against a support surface, the outer surface having two spaced-apart openings therein, each opening defined by a perimeter; and a first hub and a second hub, each first and second hub configured to hold a roll of sheet material thereon, each first and second hub having a first end and a second end, the first end of each first and second hub positioned to extend through one of the openings in the housing, each first and second hub including a flange positioned radially around a portion of each first and second hub near the second end thereof, each flange configured to have a perimeter sized larger than the perimeter of each opening, each flange of each first and second hub being supported against the outer surface of the housing, each first and second hub being configured to be removed through one opening in the outer surface and reinserted through one opening in the outer surface into one of two hub positions provided in the perimeter of each opening, each first and second hub having a first end extending into the internal compartment and each flange positioned against the outer surface, each flange cooperating with each opening to position each first and second hub in a horizontal alignment relative to each other in a first hub position to hold two mid-sized rolls in horizontal alignment within the housing, each flange cooperating with each opening to position each first and second hub out of horizontal alignment relative to each other in a second hub position such that the first hub is positioned to hold a jumbo roll and the second hub is positioned to hold a stub roll within the housing.

2. The dispenser of claim 1, wherein the housing includes a cover and a back plate.

3. The dispenser at claim 2, wherein each opening and the perimeter thereof is provided in the back plate.

4. The dispenser of claim 2, wherein each flange is configured to be removably coupled to the back plate.

5. The dispenser of claim 1, wherein the perimeter of each opening includes a pair of convex portions.

6. The dispenser of claim 5, wherein each convex portion provides one of two hub positions.

7. The dispenser of claim 3, wherein a retaining rib is provided on the outer surface of the back plate.

8. The dispenser of claim 7, wherein each flange of each first and second hub is positioned in and retained by the retaining rib.

9. The dispenser of claim 8, wherein each flange of each first and second hub has a perimeter larger than the perimeter of each opening but smaller than a perimeter of the retaining rib.

10. The dispenser of claim 2, wherein each first and second hub is configured to be positioned in a perpendicular position relative to the back plate, and wherein each first and second hub is supported by its flange positioned in parallel alignment against the outer surface of the back plate to prevent displacement of each first and second hub.

11. A dispenser for storing and dispensing rolled sheet material, the dispenser comprising:

a housing having a lower end and an internal compartment configured to hold at least two rolls of sheet material therein, the housing formed to include an exit port, the housing having an outer surface positioned against a support surface, the outer surface having two spaced-apart openings therein, each opening defined by a perimeter, a first hub and a second hub, each first and second hub configured to hold a roll of sheet material thereon, each first and second hub having a first end and a second end, the first end of each first and second hub being positioned to extend through one of the openings in the housing, each first and second hub including a flange positioned radially around a portion of each first and second hub near the second end, each flange configured to have a perimeter sized larger than the perimeter of each opening, each flange of each first and second hub being supported against the outer surface of the housing, each first and second hub being configured to be removed through one opening in the outer surface and reinserted through one opening in the outer surface in one of two hub positions provided in the perimeter of each opening, each first and second hub having a first end and extending into the internal compartment, each flange positioned against the outer surface and each flange cooperating with each opening to position each first and second hub in a first hub position in horizontal alignment relative to each other to hold two mid-sized rolls in horizontal alignment within the housing, each flange cooperating with each opening to position each first and second hub in a second hub position out of horizontal alignment relative to each other such that the first hub is positioned to hold a jumbo roll and the second hub is positioned to hold a stub roll, the first hub and the second hub positioned in an oblique alignment relative to the lower end of the housing.

12. The dispenser of claim 11, wherein the housing includes a cover and a back plate.

13. The dispenser of claim 12, wherein each opening and each perimeter thereof are provided in the back plate.

14. The dispenser of claim 12, wherein each flange is configured to be removably positioned in parallel alignment against the outer surface of the back plate.

15. The dispenser of claim 12, wherein the perimeter of each opening includes a pair of convex portions.

16. The dispenser of claim 15, wherein each convex portion provides one of two hub positions.

17. The dispenser of claim 12, wherein a retaining rib is provided on the outer surface of the back plate.

18. The dispenser of claim 17, wherein each flange of each first and second hub is positioned in and retained by at least a portion of the retaining rib.

19. The dispenser of claim 18, wherein each flange of each first and second hub has a perimeter larger than the perimeter of each opening but smaller than a perimeter of the retaining rib.

20. The dispenser of claim 12, wherein each first and second hub is configured to be positioned in a perpendicular position relative to the back plate, and wherein each first and second hub is supported by its flange positioned in parallel alignment against the outer surface of the back plate to prevent dislodgement of each first and second hub.

* * * * *